United States Patent [19]

Evans

[11] 3,989,574

[45] Nov. 2, 1976

[54] AUTOMATIC LABEL APPLYING APPARATUS

[75] Inventor: Thomas S. Evans, Libertyville, Ill.

[73] Assignee: Sturtevant Industries, Inc., Sturtevant, Wis.

[22] Filed: Jan. 15, 1975

[21] Appl. No.: 541,086

[52] U.S. Cl. ..... 156/351; 156/352; 156/363; 156/368; 156/566; 156/570; 156/583; 156/DIG. 44

[51] Int. Cl.² ..... B65C 1/02; B65C 9/40

[58] Field of Search ..... 156/351, 352, 358, 360, 156/363, 366, 566, 570, 571, 364, 368, 583, DIG. 44

[56] References Cited

UNITED STATES PATENTS

| | | | |
|---|---|---|---|
| 3,232,815 | 2/1966 | Klopfenstein et al. | 156/566 |
| 3,264,161 | 8/1966 | Stremke, Jr. | 156/360 |
| 3,284,265 | 11/1966 | Carroll et al. | 156/566 |
| 3,372,079 | 3/1968 | Fellner et al. | 156/360 |
| 3,616,094 | 10/1971 | Navin et al. | 156/360 |
| 3,751,321 | 8/1973 | Hagemann et al. | 156/368 |
| 3,769,139 | 10/1973 | Woods | 156/566 |

*Primary Examiner*—William A. Powell
*Assistant Examiner*—Basil J. Lewris
*Attorney, Agent, or Firm*—James E. Nilles

[57] ABSTRACT

Automatic label applying apparatus comprises a conveyor for moving packages to a weigh scale and from thence to a label application station where a reciprocably movable vacuum type heated label applicator receives an appropriately printed label from a label issuing means and applies it to the appropriate package. A vacuum system connected to the label applicator holds the label thereon and also operates a pneumatic cylinder for a lock-out arm to prevent the heated label applicator from making contact with and burning a package when the vacuum system senses that no label is present. An electronic control system, including a photocell for sensing if a package is at the station and also including a limit switch actuated by the lock-out arm (and therefore indicative of the presence or absence of a label), operates to stop the conveyor after a predetermined interval of time in the event that a package is present at the station but no label is available to the label applicator. The electronic control system includes an adjustable time delay circuit for changing the interval of time during which the conveyor remains in operation after a package arrives at the station and before the label is applied so as to compensate for packages of different size and different conveyor speeds. An optionally usable warning device is included in the control system to warn that no label is present. Furthermore, an optionally usable control switch is provided to enable the conveyor (but not the label applicator) to continue in operation even though no labels are available.

10 Claims, 3 Drawing Figures

AUTOMATIC LABEL APPLYING APPARATUS

BACKGROUND OF THE INVENTION

1. Field of Use

This invention relates generally to automatic label applying apparatus which comprises a motor driven conveyor for advancing packages to a weighing scale and then to a label application station where a movable heated label applicator applies an appropriately printed label. In particular, the invention relates to such apparatus including means sensing if a package is present at the station, for sensing if a label is available for application and for preventing contact of the heated label applicator with the package and for stopping the conveyor after a short interval of time after a package arrives at the station but no label is in readiness to be applied.

2. Description of the Prior Art

U.S. Pat. Nos. 3,372,079; 3,605,986; 3,616,094; 3,264,161; and 3,751,321 disclose prior art apparatus, or parts thereof, which weigh a package and transmit the weight information to a label printer which then prints the weight and other data on a label. The printed label is then automatically transferred from a label issuing means by means of a vacuum transfer nozzle (usually heated) for application to the package. If packages are fed to the apparatus while the label issuing means has ceased to issue labels, there results an accumulation of unlabelled packages which need to be reprocessed through the machine. Absence of labels may, for example, be due to the fact that the label magazine has run out of labels or a label has jammed inside the printing mechanism or for some other reason. Furthermore, if the label applicator is heated and no label is disposed thereon, the package may be burned and damaged if the machine comes to rest with the label applicator in contact with the package.

U.S. Pat No. 3,751,321 discloses apparatus wherein a vacuum sensor is provided to sense the absence of a label on the vacuum transfer nozzle and to automatically stop the machine conveyor, thereby preventing continued advancement of packages to the label application station. A package sensor in the form of a photoresponsive device is located in the path of travel of the packages. The package sensor is actuated by a package moving to the label application station. The package sensor energizes a package sensing relay which conditions the circuit for subsequent operation. If a label is not transferred by the vacuum transfer nozzle, a vacuum sensor switch remains closed and its label sensing relay stays energized until a cam driven by the machine motor completes one revolution and actuates a limit switch to stop the conveyor motor. However, if a label is transferred, the increase in suction or lack of pressure in the vacuum line connected to the vacuum transfer nozzle causes the vacuum sensor switch to open and interrupt current flow to the coil of another relay which then permits the conveyor motor to continue to run even though the cam completes one cycle of operation and the limit switch is actuated. This apparatus employs a cam operated limit switch to stop the machine conveyor in the event that a package is present at the labelling station for an interval of time no label is in readiness to be applied during the interval. It is desirable, however, to avoid the use of a machine driven cam operating limit switch for this purpose for several reasons. For example, in such an arrangement, the length of the time interval which can exist before the conveyor stops needs to be varied to accommodate packages of different size and to suit the speed at which the apparatus is set to operate. It is difficult, time consuming and relatively costly with such a cam operated switch arrangement to vary the time interval because it is necessary to change cam sizes or cam types or alter the switch settings.

SUMMARY OF THE INVENTION

Automatic label applying apparatus in accordance with the invention comprises a conveyor for moving packages to a weigh scale and from thence to a label application station where a reciprocably movable vacuum type heated label applicator receives an appropriately printed label from a label issuing means and applies it to the appropriate package. A vacuum system connected to the label applicator holds the label thereon and also operates a pneumatic cylinder for a lock-out arm to prevent the heated label applicator from making contact with and burning a package when the vacuum system senses that no label is present. An electronic control system, including a photocell for sensing if a package is at the station and also including a limit switch actuated by the lock-out arm (and therefore indicative of the presence or absence of a label), operates to stop the conveyor after a predetermined interval of time in the event that a package is present at the station but no label is available to the label applicator. The electronic control system includes an adjustable time delay circuit for changing the interval of time during which the conveyor remains in operation after a package arrives at the station and before the label is applied so as to compensate for packages of different size and different conveyor speeds. An optional audible warning device is included in the control system to warn that no label is present. Furthermore, an optionally audible control switch is provided to enable the conveyor (but not the label applicator) to continue in operation even though no labels are available.

Automatic label applying apparatus in accordance with the invention operates to prevent packages on the conveyor from being burned by a heated label applicator when no label is present. Furthermore, the apparatus can more easily be adjusted to handle packages of different sizes and to operate at different speeds than prior art apparatus because the interval between the time a package arrives at the station and the time a label is sensed as being present or absent is electronically controlled and can be altered to suit package size or machine operating speed merely by adjusting a rheostat without the need to change cams or gears. The apparatus includes adjustable time delay means which are completely electronic and which can be adjusted without tampering with mechanical portions of the machine. Furthermore, no specially sized cams or gears or other paraphernalia need to be kept on hand to enable time interval adjustment.

THE DRAWINGS

DESCRIPTION OF A PREFERRED EMBODIMENT

Figure 1:
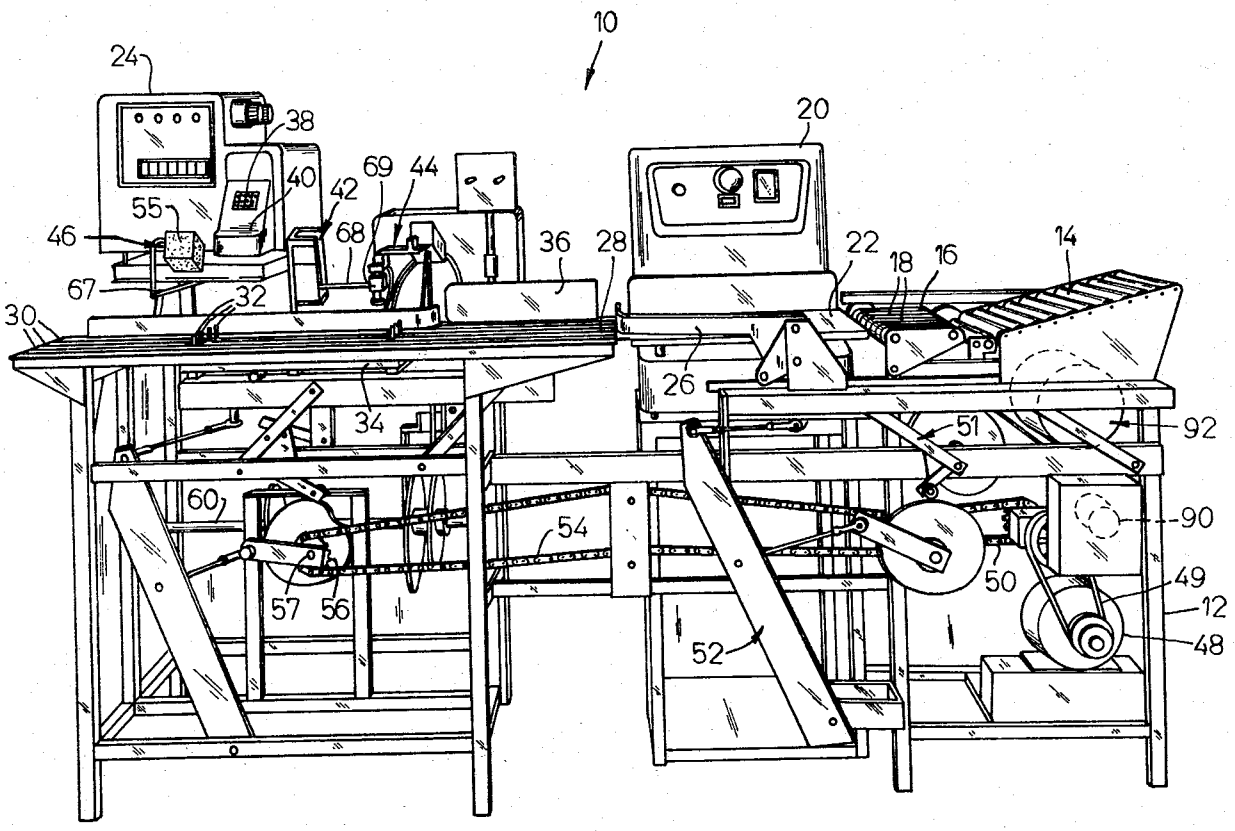
FIG. 1 is a perspective view of labelling apparatus embodying the invention taken from one side thereof.

Referring to FIG. 1, the numeral 10 generally designates automatic label printing and applying apparatus in accordance with the invention. Apparatus 10 comprises a suitable supporting framework 12 on which are mounted a sloped roller gravity type delivery conveyor 14 onto which unlabelled packages descend from a suitable source (not shown) and a tiltable roller platter 16 having driven belts 18 thereon for receiving packages from roller conveyor 14 and delivering them to a scale 20 having a package weighing surface 22. Scale 20 senses package weight and transmits signal information to a label printer 24 concerning package weight and that a package is about to be presented for labelling. A sweep arm 26 is provided for moving the packages from scale surface 22 onto a slotted surface 28 having slots 30 therein for accommodating the vertically and horizontally movable pins 32 of a disappearing pin type conveyor 34 which conveys the packages along surface 28 to a label application station and from thence, after labelling, off of surface 28 and onto another conveyor (not shown). Sweep arm 26 aligns the packages longitudinally of slotted surface 28 and a pusher arm 36 engages the packages and aligns them transversely of the surface.

Label printer 24 comprises label issuing means 38 including a trough or dispenser 40 from whence a printed label is lifted by a label pick-up and transfer means 42 and delivered to a label applicator means 44 for application to an appropriate package. A label patting means 46 is provided to insure that the label is securely attached to each package after its application.

An electric motor 48 is provided to continuously drive the conveyor 34, the arms 26 and 36, the label transfer means 42, the label applicator means 44 and the label patting means 46. An electric motor 92 is provided to drive the roller platter belts 18 and a vacuum pump 90, hereinafter described. These elements are driven continuously and in synchronism when the apparatus is in operation, regardless of whether or not packages are present and being advanced whereas the scale 20, the label printer 24, and the label issuing means 38 only function when a package is presented to scale 20. As FIG. 1 shows, motive power from motor 48 is transmitted to a reducer **48*a* by a drive belt 49; to the sweep arm 26 by a drive chain 50 and the linkages 51 and 52, and to the disappearing pin conveyor 34, the label transfer means 42, the label applicator means 44 and the label patting means 46 by a drive chain 54.** The apparatus thus far described employs component parts which are generally similar in construction and mode of operation to apparatus disclosed and described in detail in U.S. Pat. Nos. 3,372,079; 3,605,986; and 3,616,094 which are assigned to the same assignee as the present application.

Figure 2:
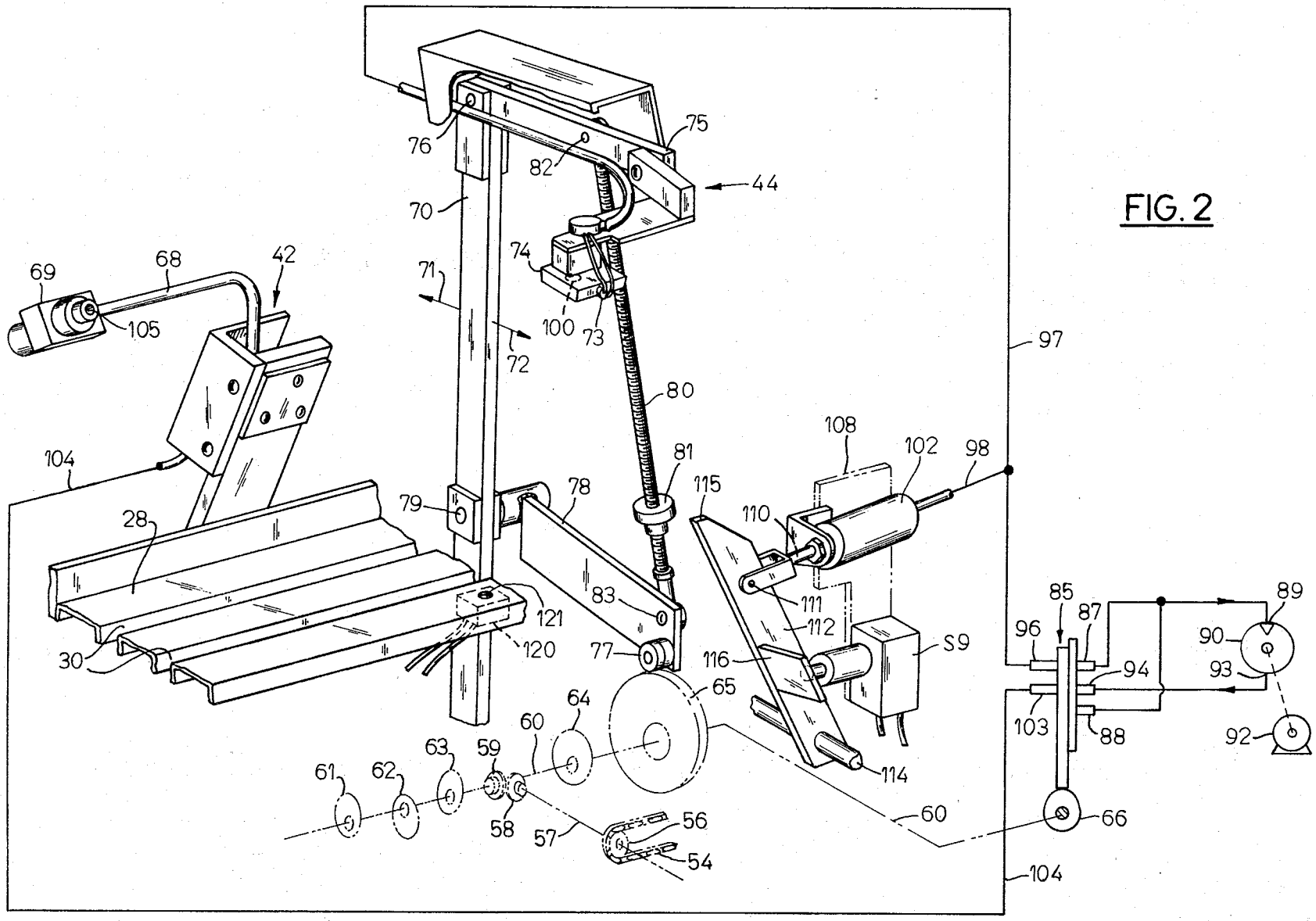
FIG. 2 is an enlarged perspective view, partly schematic, of certain components in the apparatus shown in FIG. 1.

Referring to FIGS. 1 and 2, drive chain 54 is trained around a gear 56 affixed to a shaft 57 which is rotatably mounted on framework 12 and which has another gear 58 in constant mesh with a third gear 59 affixed to a transversely disposed shaft 60 which is rotatably mounted on framework 12. Shaft 60 is provided with and drives six cams 61, 62, 63, 64, 65, and 66 for effecting synchronized operation of certain system components.

Cam 61 effects vertical reciprocating movement of an arm 67 of label patting means 46 which has a sponge block 55 secured thereto.

Cam 62 operates the trip mechanism for the label printing means 24 and the label issuing means 38 (provided a signal has been received from scale 20).

Cam 63 operates the label pick-up and transfer means to effect swinging of the pick-up arm or tube 68 and the pick-up head 69 between the positions shown in phantom in FIG. 1 (see also FIG. 2) and the position shown in solid lines in FIG. 1.

Cam 64 operates to effect generally horizontal reciprocating or oscillating movement of a pivotably movable actuator arm 70 of the label applicator means 44 in the direction of the arrows 71 and 72 shown in FIG. 2.

Cam 65 operates to raise and lower a label applicator block 74 which is rigidly (but adjustably) secured to the end of a lift arm 75 which, in turn, is pivotally connected by a pin 76 to the upper end of actuator arm 70. Applicator block 74 is provided with a heating element 73 for heating the adhesive on the labels supplied thereto. Cam 65 cooperates with a cam follower roller 77 on a lift lever 78 which is pivotally connected by a pin 79 to actuator arm 70. A threaded lift rod 80 having an adjustably movable thread stop member 81 thereon is pivotably connected at its opposite end by pins 82 and 83 to the lift arm 75 and the lift lever 78, respectively.

Cam 66 operates or actuates a two-position four-way air (vacuum) control valve 85 which has ports 87 and 88 connected to the vacuum port 89 of a vacuum pump 90 which is driven by electric motor 92. Vacuum pump 90 has a pressure port 93 which is connected to a port 94 on valve 85. Control valve 85 has a port 96 connected by lines or tubes 97 and 98 to an aperture 100 in label applicator block 74 and to a double-acting pneumatic cylinder 102, respectively. Control valve 85 also has a port 103 connected by a line or tube 104 which, for example, extends through the hollow pick-up arm 68 and communicates with an aperture 105 in label pick-up and transfer head 69.

As FIG. 2 shows, cylinder 102 is physically mounted in fixed position on a bracket 108 secured to framework 12 and has its cylinder rod 110 pivotally connected by a clevis pin 111 to a reciprocably movable lockout arm 112 on a pin, rod, or shaft 114. The end surface 115 of lock-out arm 112 is movable into interfering relationship with stop member 81 by cylinder 102 to prevent downward movement of label applicator block 74 under certain circumstances as hereinafter explained. Bracket 108 also physically supports a push-button type limit switch S9 which is operated by a plate 116 attached to lockout arm 112. Switch S9 is open or closed when cylinder rod 110 is extended or retracted, respectively.

As FIGS. 1 and 2 show, a photo-electric cell 120 is provided beneath an aperture 121 in table surface 28 at the label application station and is responsive to the presence or absence of ambient light to sense or indicate that a package is not present or present, respectively, at the label application station.

Figure 3:
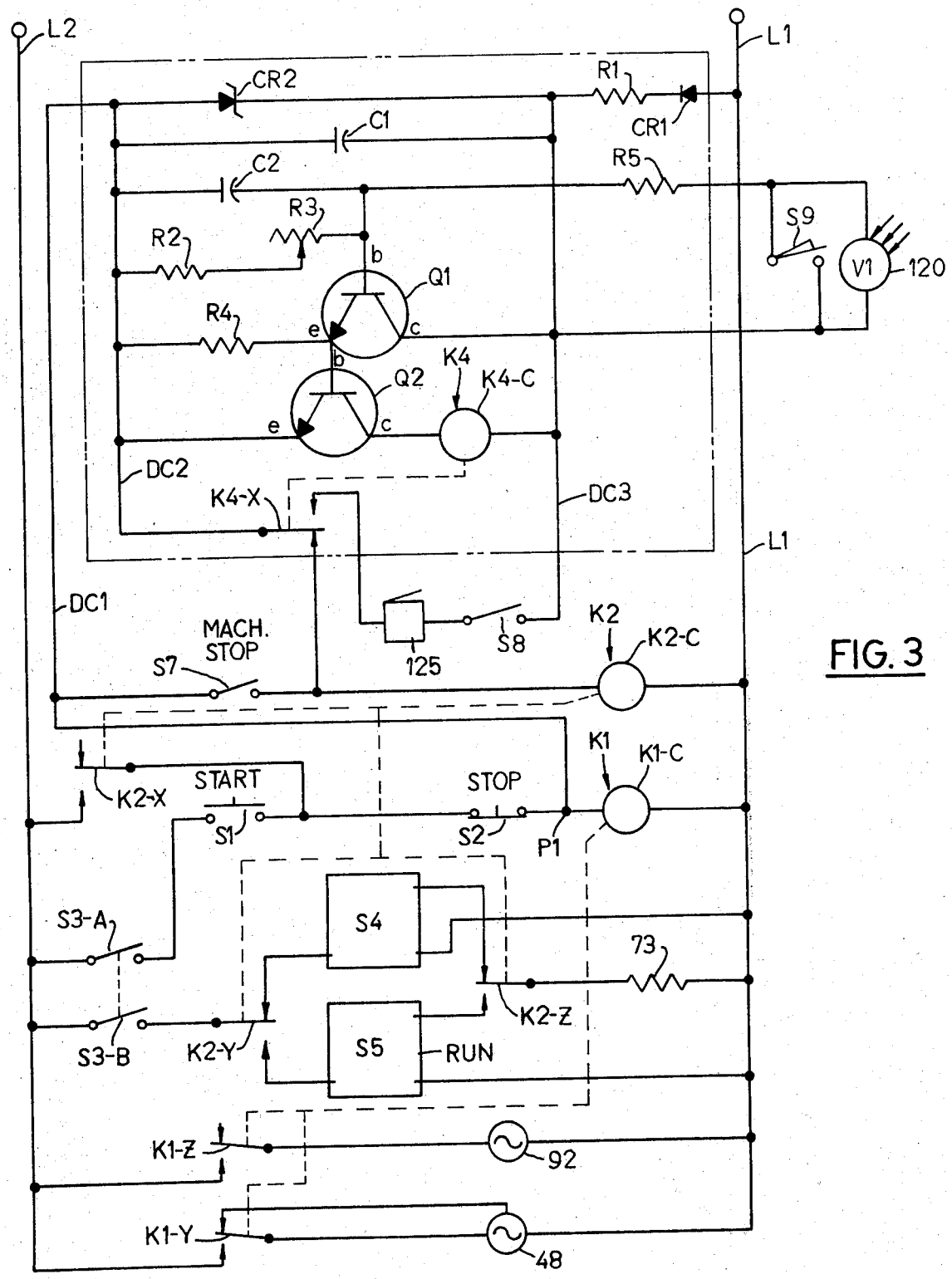
FIG. 3 is a schematic diagram of a portion of the electrical control circuit for the apparatus shown in FIGS. 1 and 2.

The arrival of a package at the label application station triggers (darkens) the photocell 120 but since the apparatus has not yet completed its cycle up to the point where the package is labelled and ready for delivery, a time delay means, hereinafter described, is provided to insure that an adequate period of time elapses during which a label may be delivered to the applicator block 74 and applied to the package. In the event that a package arrives at the label application station and no label is available to the applicator block 74, then, after the time delay, the label sensing means (i.e., the vacuum system) causes the lock-out arm 112 to remain stationary and thereby engage the stop member 81 to hold the applicator block 74 in a raised position where it cannot engage a package and burn or melt the wrapping and thereafter the conveyor motor 48 and the pump motor 92 are stopped. The label sensing means operates as follows. When a label is present on the applicator block 74, a vacuum exists at port 100 (to hold the label) and in the passages or conduits 97 and 98 and this causes the lock-out arm 112 to move or retract. In this condition the applicator block 74 can move up and down relative to the advancing packages. However, in the absence of a label on the applicator block 74, there will be pressure (no vacuum) in passages 97 and 98 and vacuum cylinder 102 will not move the lock-out arm 112 out of interfering relationship with stop member 81 wherein it will hold the applicator block 74 in its uppermost position. Under such conditions, the switch S9 is open and, after the time delay interval, the electronic control system will shut off power to main motor 48 and pump motor 92, provided the switch S7 shown in FIG. 3 is in the open position shown. If switch S7 is closed, the motors 48 and 92 will remain in operation. If switch S7 is open and the conveyor has stopped, it can be restarted by means of start switch S1.

As FIG. 3 shows, the main motor 48 and the vacuum pump motor 92 are supplied with operating power from a conventional 120-volt single-phase alternating current electric power source comprising the supply lines L1 and L2. The motors 92 and 48 are connected across the supply lines L1 and L2 in series with normally open relay contacts K1-Z and K1-Y, respectively, of a relay K1.

As FIG. 3 shows, the electronic control circuit comprises the aforementioned relay K1; a manually operable motor start switch S1; a manually operable motor stop switch S2; the heating element 73 which can be switched from standby (low heat) to run (high heat) condition by means of a relay K2 (which includes a holding contact K2-X for the motor start switch S1); a relay K4 which controls energization of the relay coil K2-C and a warning buzzer 125 (which is optionally usable by means of a selector switch S8). Energization of the relay coil K4-C of relay K4 is controlled by the photoelectric cell 120, the label sensing switch S9, and a time delay circuit including the resistor R2 and potentiometer R3 and a capacitor C2.

More specifically, the coil K1-C of relay K1 is connected across the lines L1 and L2 in series with normally closed manually operable pushbutton stop switch S2, normally open manually operable pushbutton start switch S1, and the contacts 3A of a normally open manually operable double pole single throw master switch S3. Master switch S3 also comprises a pair of normally open contacts S3B which when closed place in readiness the standby and run units S4 and S5, respectively, for heater coil 73. When standby unit S4 is energized by the relay contacts K2-Y and K2-Z (i.e., when a relay coil K2-C of a relay K2 is de-energized), the heater coil 73 operates at a lower amperage than when the run unit S5 is energized by the relay contacts K2-Y and K2-Z (i.e., when relay coil K2-C or relay K2 in energized).

Relay coil K2-C of relay K2 is connected on one side of line L1 and is connectable on its other side to a supply line DC1 either through normally open manually operable single pole single throw stop switch S7 or through a relay contact K4-X of relay K4. Supply line DC1 is connected between a point P1 (between stop switch S2 and coil K1-C) and supply line L1 and has a half-wave rectifier CR1, a voltage dropping resistor R1 and a voltage regulating Zener diode CR2 in series circuit therein.

Coil K4-C of relay K4 is energized either in response to actuation of photoelectric cell 120 by ambient light (indicating no package present) or by closure of limit switch S9 (indicating label present) or by the time delay means. Relay K4 comprises a two-position relay contact K4-X which either energizes relay coil K2-C of relay K2 (when no package is present or during the time delay interval) or energizes the buzzer 125 (when a package is present after the time delay interval and no label is available, provided the buzzer selector switch S8 is closed). Relay coil K4-C is energizable from a source of half-wave rectified direct current comprising the supply lines DC2 and DC3 which are connected on opposite sides of Zener diode CR2. Relay coil K4-C has one side connected to conductor DC3 and has its other side connected to conductor DC2 in series with the collector and emitter terminals *c* and *e* of an NPN transistor Q2. The base terminal *b* of transistor Q2 is connected to the emitter terminal *e* of an NPN transistor Q1. Terminal *e* of transistor Q1 is connected to conductor DC2 through a current limiting resistor R4. Collector terminal *c* of transistor Q1 is connected to conductor DC3. The base terminal *b* of transistor Q1 is connected to conductor DC2 through a capacitor C2 and through the series-connected adjustable potentiometer R3 and fixed resistor R2. Capacitor C2 and resistors R3 and R2 cooperate to provide an adjustable R/C time delay means or circuit. Potentiometer R3 enables adjustment of the time required for the capacitor C2 to discharge. The speed at which the machine is being operated and package size determines the setting of the potentiometer R3 and, for all practical purposes, set-up of the machine includes the setting of a fixed speed of machine operation and the serviceman adjusts the potentiometer R3 to account for the machine's speed and package size. Photoelectric cell 120 has one side connected to conductor DC3 and has its other side connected to base terminal *b* of transistor Q1 in series with a current limiting resistor R5. A capacitor C1 is connected across the conductors DC2 and DC3 to filter the half-wave rectified current and to supply the buzzer 125 with a low voltage direct current for approximately 3 seconds after the circuit has been de-energized.

I claim:

1. In apparatus for applying labels to packages:

a label application station, a conveyor operable to convey a package to said station, drive means for driving said conveyor, label application means for applying a label to said package after arrival at said station, package sensing means for sensing when said package arrives at said station, label sensing means for sensing whether a label is available to said label application means, and control means for said drive means and responsive to said package sensing means and to said label sensing means, said control means including timing means to maintain said conveyor in operation for a predetermined interval of time after said package arrives at said station and to stop said conveyor after said interval of time if no label is available for application to said package during said interval of time, said timing means being adjustable for changing the length of said predetermined interval of time, said control means comprising an electrical control circuit wherein said package sensing means includes first switch means operable to maintain said conveyor in operation when no package is present at said station and tending to stop said conveyor when a package is present at said station, wherein said label sensing means includes second switch means in parallel with said first switch means and operable to maintain said conveyor in operation when a label is available and tending to stop said conveyor when no label is available, and wherein said timing means comprises a resistor and a capacitor forming an R/C circuit connected to said first and second switch means and operable to maintain said conveyor in operation for a predetermined interval of time during which said first and second switch means both tend to stop said conveyor, said resistor being a variable resistor and adjustable to change said predetermined interval of time.

2. Apparatus according to claim 1 wherein said electrical control circuit comprises a transistor connected to be controlled by said first and second switch means and by said R/C circuit.

3. Apparatus according to claim 2 wherein said transistor operates a relay which controls operation of said conveyor drive means.

4. Apparatus according to claim 3 wherein said control means includes warning means for producing a warning signal in the event said conveyor stops, said warning means comprising an electrically operable warning device controlled by said relay.

5. Apparatus according to claim 1 wherein said control means includes means for producing a warning signal in the event said conveyor stops.

6. In apparatus for applying labels to packages:

a label application station, a conveyor operable to convey a package to said station, label application means for heating the adhesive on a label and for applying the label to said package after arrival at said station, said label application means being movable into and out of engagement with a package at said station, drive means for driving said conveyor and said label application means, lock-out means operable to hold said label application means out of engagement with a package, package sensing means for sensing when said package arrives at said station, label sensing means for sensing whether a label is available to said label application means, and control means responsive to said package sensing means and to said label sensing means and including adjustable timing means to maintain said conveyor in operation for a predetermined interval of time after said package arrives at said station, to operate said lock-out means, and to stop said conveyor after said interval of time if no label is available for application to said package during said interval of time, said control means comprising an electrical control circuit wherein said package sensing means includes photoresponsive switch means operable to maintain said conveyor in operation when no package is present at said station and tending to stop said conveyor when a package is present at said station, wherein said label sensing means includes switch means in parallel with said photoresponsive switch means and operable by said lock-out means to maintain said conveyor in operation when a label is available and tending to stop said conveyor when no label is available, and wherein said adjustable timing means comprises a variable resistor and a capacitor forming an R/C circuit operable to maintain said drive means in operation for a predetermined interval of time during which both said switch means tend to stop said conveyor.

7. Apparatus according to claim 6 wherein said electrical control circuit comprises a transistor connected to be controlled by said photoresponsive switch means, by said lock-out operated switch means, and by said R/C circuit.

8. Apparatus according to claim 7 wherein said transistor operates a relay which controls operation of said drive means.

9. Apparatus according to claim 8 wherein said control means includes warning means for producing a warning signal in the event said conveyor stops, said warning means comprising an electrically operable warning device controlled by said relay.

10. Apparatus according to claim 9 wherein said warning device is energizable from a capacitor so that said warning device remains energized after said relay operates to disconnect said warning device from an alternate source of power.

* * * * *